United States Patent [19]

Mester et al.

[11] Patent Number: 4,642,177

[45] Date of Patent: Feb. 10, 1987

[54] PROCESS FOR REDUCING SULFUR OXIDE EMISSIONS FROM CATALYTIC CRACKING UNITS

[75] Inventors: Zoltan C. Mester, Laguna Niguel; Edward J. Aitken, Brea, both of Calif.

[73] Assignee: Union Oil Company of California, Los Angeles, Calif.

[21] Appl. No.: 781,755

[22] Filed: Sep. 30, 1985

[51] Int. Cl.[4] ..... C10G 11/00; C01B 17/60

[52] U.S. Cl. ..... 208/113; 208/120; 423/21.1; 423/244; 502/332

[58] Field of Search ..... 208/113, 120; 423/244 R, 21.1

[56] References Cited

U.S. PATENT DOCUMENTS

| | | | |
|---|---|---|---|
| 3,375,061 | 3/1968 | Healy et al. | 423/21.1 |
| 3,931,390 | 1/1976 | Palilla et al. | 423/244 |
| 4,022,870 | 5/1977 | Palilla et al. | 423/244 |
| 4,051,219 | 9/1977 | Hafner | 423/21 |
| 4,153,534 | 5/1979 | Vasalos | 208/120 |
| 4,233,276 | 11/1980 | D'Souza et al. | 423/230 |
| 4,238,317 | 12/1980 | Vasalos et al. | 208/120 |
| 4,252,635 | 2/1981 | Blanton, Jr. | 208/114 |
| 4,252,636 | 2/1981 | Mooi | 208/120 |
| 4,280,898 | 7/1981 | Tatterson et al. | 208/119 |
| 4,311,581 | 1/1982 | Baron et al. | 208/115 |
| 4,325,814 | 4/1982 | Gross | 208/120 |
| 4,341,661 | 7/1982 | Baron et al. | 502/65 |
| 4,366,083 | 12/1982 | Baron et al. | 502/38 |
| 4,381,991 | 5/1983 | Bertolacini et al. | 208/113 |
| 4,423,019 | 12/1983 | Bertolacini et al. | 423/244 |
| 4,497,902 | 2/1985 | Bertolacini et al. | 502/65 |
| 4,589,978 | 5/1986 | Green et al. | 208/113 |

FOREIGN PATENT DOCUMENTS

| | | | |
|---|---|---|---|
| 866715 | 4/1961 | United Kingdom | 423/21.1 |
| 2032947 | 5/1980 | United Kingdom . | |

*Primary Examiner*—Brian E. Hearn
*Assistant Examiner*—O. Chaudhuri
*Attorney, Agent, or Firm*—Yale S. Finkle; Gregory F. Wirzbicki; Dean Sandford

[57] ABSTRACT

A sulfur sorbent for use in reducing the emissions of sulfur oxides from regenerators of cyclic catalytic cracking units comprises a rare earth component or mixture of rare earth components in combination with a porous, inorganic refractory oxide component. The rare earth components used as a portion of the sorbent are preferably derived from the mineral bastnaesite by treating the bastnaesite to remove at least 50 weight percent of its fluorine, calculated as the element. The activity of the sulfur sorbent for removing sulfur oxides during catalytic cracking processes is increased to unexpectedly high levels by including in the composition cobalt or other transition metal component comprising an element selected from Group IB, Group IIB, Group IVA, Group VA, Group VIA, Group VIIA, and Group VIII of the Periodic Table of Elements.

25 Claims, No Drawings

PROCESS FOR REDUCING SULFUR OXIDE EMISSIONS FROM CATALYTIC CRACKING UNITS

BACKGROUND OF THE INVENTION

This invention relates to the reduction of sulfur oxide emissions from regenerators associated with catalytic cracking units and is particularly concerned with reducing the emissions of sulfur oxides utilizing a sorbent containing rare earth constituents.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasion such feedstocks as light gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed to a catalytic reactor, normally referred to as a riser, wherein the mixture is subjected to a temperature between about 800° F. and about 1100° F. in order to convert the feedstock into gaseous, lower boiling hydrocarbons. After these lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbons that are then combined with the vapors exiting the cyclone separator to form a mixture that is subsequently passed downstream to other facilities for further treatment. The coke-containing catalyst particles recovered from the stripper are introduced into a regenerator where the catalyst is reactivated by combusting the coke in the presence of an oxygen-containing gas, such as air, at a temperature which normally ranges between about 1000° F. and about 1500° F. The cyclic process is then completed by blending the reactivated catalyst particles with the feedstock entering the riser or reaction zone of the FCC unit.

A major problem associated with FCC units occurs when the hydrocarbon feedstock contains organic sulfur compounds. The sulfur compounds in such a feedstock are converted to hydrogen sulfide in the catalytic reaction zone and stripping zone so that the bulk of the sulfur in the feedstock is recovered as hydrogen sulfide with the product vapors and later separated therefrom in downstream facilities, normally by contact with an aqueous alkanolamine solution. Some of the sulfur components, however, remain, or are converted to forms which remain, with the coke on the deactivated catalyst recovered from the stripper. Thus, when the coke is combusted in the regenerator, a flue gas. containing sulfur oxide compounds is generated. This flue gas, if untreated, is a source of pollution. Although between 90 and 95 percent of the sulfur compounds entering an FCC unit with the feedstock are ultimately removed as hydrogen sulfide and other gaseous sulfur compounds in the reactor and stripper, the remaining 5 to 10 percent left with the coke and converted to sulfur oxide compounds in the regenerator represents a significant environmental and engineering problem.

In order to avoid environmental problems associated with the emissions of sulfur oxides from FCC units, various procedures have been suggested to reduce such emissions to environmentally tolerable levels. One such procedure involves circulating with the catalyst particles in the FCC unit a metal-containing component sometimes referred to as a "sulfur getter" that reacts in the regenerator with the gaseous sulfur oxide compounds to yield a spent "sulfur getter" containing solid sulfur compounds. The spent "sulfur getter" is then reconverted to an active sorbent by passage through the riser and stripper wherein the solid sulfur compounds are converted to hydrogen sulfide. The hydrogen sulfide is then recovered with the low-boiling hydrocarbons produced in the stripper and riser and passed to downstream units where the hydrogen sulfide is separated therefrom.

Normally, the "sulfur getter" or sulfur sorbent utilized in the catalytic cracking process must be prepared by processes involving substantial manufacturing costs. In an effort to reduce such costs, U.S. Pat. Nos. 4,311,581; 4,341,661; and 4,366,083, all of which are hereby incorporated by reference in their entireties, teach the use of bastnaesite, an abundant and inexpensive material, as a sulfur sorbent for removing sulfur oxides from the flue gases produced in FCC regenerators. It has been found, however, that although bastnaesite is initially a very active sorbent, its initial activity decays rapidly with repeated cycling from the riser and stripper to the regenerator and back again.

Accordingly, it is one of the objects of the present invention to provide a sulfur sorbent derived from bastnaesite that will retain its activity for sulfur oxides removal during cyclic catalytic cracking operations. It is another object of the invention to provide a sulfur sorbent of increased activity for reducing emissions of sulfur oxides during cyclic catalytic cracking operations. These and other objects of the invention will become more apparent in view of the following description of the invention.

SUMMARY OF THE INVENTION

In accordance with the invention, it has now been found that the emissions of sulfur oxides from catalytic cracking processes in which sulfur-containing hydrocarbon feedstocks are refined into valuable hydrocarbon products can be reduced by utilizing a sulfur sorbent comprising a rare earth component or mixture of such components, particularly rare earth components derived from bastnaesite by treating the bastnaesite to remove at least 50 weight percent of its fluorine content, calculated as the element. It has been further found that the activity of such a sorbent for removing sulfur oxides during catalytic cracking can be further increased by utilizing in combination with the rare earth components a transition metal component comprising one or more metals selected from the group consisting of the Group IB, Group IIB, Group IVA, Group VA, Group VIA, Group VIIA, and Group VIII of the Periodic Table of Elements. As used herein "Periodic Table of Elements" refers to the version officially approved by the International Union of Pure and Applied Chemistry (IUPAC) in its 1970 rules. An example of such a table may be found in the inside back cover of the book entitled "Advanced Inorganic Chemistry," Fourth Edition, which is authored by F. A. Cotton and G. Wilkinson and was published in 1980 by Wiley Interscience of New York. A preferred transition metal component for use with the rare earth components comprises cobalt. Normally, the rare earth components and transition metal component will be supported on a porous, inorganic refractory oxide component such as alumina.

As mentioned above, the rare earth components of the sulfur sorbent may be derived from bastnaesite by treating the bastnaesite to remove at least 50 weight percent fluorine, calculated as the element. The bastnaesite is preferably treated by a process in which the bastnaesite particles are contacted with a mineral acid to form a fluorine-containing solid residue and a solution of soluble rare earth components containing dissolved fluorine components. The solution of rare earth components is then typically contacted with oxalic acid to precipitate a mixture of essentially fluorine-free rare earth oxalates, and these rare earth oxalates are dissolved in a mineral acid to form the rare earth components that are used as part of the sulfur sorbent.

The process of the invention is especially designed for lowering the emissions of sulfur oxides from FCC units and other cyclic catalytic cracking processes wherein the catalyst particles are circulated successively through catalytic cracking, steam stripping, and regeneration zones. The sulfur sorbent of the invention is believed to react with sulfur oxide compounds, sulfur dioxide ($SO_2$) and sulfur trioxide ($SO_3$), in the regeneration zone, thereby reducing the amount of such compounds discharged into the atmosphere with the flue gas leaving the regenerator. Subsequently, solid sulfur compounds contained within the sorbent are converted to hydrogen sulfide as the sorbent particles pass through the catalytic cracking and steam stripping zones of the FCC unit, thereby reactivating the sorbent particles once again for removing sulfur oxide compounds in the regeneration zone.

DETAILED DESCRIPTION OF THE INVENTION

In accordance with this invention, a fluidized catalytic cracking (FCC) process, or other cyclic catalytic cracking process in which a hydrocarbon feedstock containing sulfur compounds is refined to produce low-boiling hydrocarbon products by passage through a catalytic cracking reaction zone in the substantial absence of added molecular hydrogen is improved by introducing a sulfur sorbent into the cyclic process to reduce the amount of sulfur oxides emitted with the flue gas discharged from the regenerator. The sorbent is comprised of rare earth constituents, preferably rare earth constituents derived from bastnaesite by treating the bastnaesite to remove at least about 50 weight percent of its fluorine, calculated as the element, preferably at least 80 weight percent and most preferably at least 90 weight percent. The invention is based at least in part upon the discovery that, when bastnaesite particles are used as a sorbent, their activity for removing sulfur oxides during a cyclic catalytic cracking operation rapidly decreases. It has now been found that by removing fluorine from the bastnaesite, the resultant rare earth constituents, which are not chemically bound to fluorine, provide good long term activity for sulfur oxides removal during cyclic catalytic cracking operations.

Bastnaesite is a rare earth fluorocarbonate mineral usually found in nature in contact with zinc lodes. As the raw material, bastnaesite contains between about 65 and 80 weight percent of assorted rare earth elements, calculated as the sum of the respective rare earth oxides. Although bastnaesite contains praseodymium, neodymium, samarium, europium, and gadolinium, it primarily contains lanthanum and cerium, usually in proportions exceeding 80 weight percent of the total rare earth content of the mineral.

Although the rare earth constituents used in the sorbent of the invention may be obtained by treating natural bastnaesite found in nature, it will be understood that bastnaesite in a pretreated form, such as steamed, leached, or calcined may also be used. When natural bastnaesite is calcined and air dried at a temperature of about 700° C., the mineral undergoes a chemical reaction by which some of the rare earth fluorocarbonates therein are converted to rare earth oxyfluorides. Also, natural bastnaesite may be leached with hydrochloric acid to remove strontium and barium. Thus, it is within the scope of the invention to use bastnaesite in modified forms, and therefore, "bastnaesite" as used herein not only includes bastnaesite as found in nature but also any material having a distribution of rare earth elements to total rare earth elements substantially similar to bastnaesite. A typical chemical analysis of a natural or a treated bastnaesite reveals that the proportion of individual rare earth elements, calculated as the oxide, to the total rare earth element content, calculated as the sum of the respective rare earth oxides, falls within the following ranges: 40 to 55 weight percent cerium oxide ($CeO_2$), 20 to 35 weight percent lanthanum oxide ($La_2O_3$), 8 to 15 weight percent neodymium oxide ($Nd_2O_3$), 2.5 to 5.5 weight percent praseodymium oxide ($Pr_6O_{11}$), 0.3 to 0.7 weight percent samarium oxide ($Sm_2O_3$), 0.1 to 0.3 weight percent gadolinium oxide ($Gd_2O_3$), 0.05 to 0.15 weight percent europium oxide ($Eu_2O_3$) and 0.05 to 0.35 weight percent of other rare earth elements, calculated as their respective oxides. For purposes herein, a material is considered to be bastnaesite when its proportions of individual rare earth elements, in elemental or combined forms, to total rare earth elements, in elemental or combined forms, are substantially within the above-recited ranges. For purposes herein, any reference to a particular rare earth oxide is a reference to the rare earth oxide having the formula shown in parentheses above.

As mentioned previously, it has been found that when bastnaesite is used as a sulfur sorbent in cyclic catalytic cracking operations, it rapidly deactivates. It is believed that when the bastnaesite is subjected to the oxidizing atmosphere in the regenerator of a FCC unit or is calcined in air prior to use in the catalytic cracking operations, the rare earth fluorocarbonates therein are converted to rare earth oxyfluorides which then react with sulfur oxides to form stable compounds that are difficult to convert into hydrogen sulfide at the temperatures normally maintained in conventional catalytic cracking reaction zones. Thus, it has been found necessary to treat bastnaesite to remove a substantial amount of its fluorine in order to produce rare earth constituents which are not chemically bound to fluorine and therefore remain active during the cyclic catalytic cracking operations. Any treatment method which will remove at least 50 weight percent, preferably at least 80 weight percent and more preferably at least 90 weight percent fluorine, calculated as the element, from the bastnaesite and produce a solid or solution containing rare earth constituents that are not chemically bound to fluorine may be used. The solid or solution will preferably contain below about 10 weight percent fluorine which is chemically bound to the rare earth constituents, most preferably below about 5.0 weight percent, and will usually be substantially free of rare earth oxyfluorides. Normally, natural bastnaesite or treated forms of bastnaesite will contain between about 2 weight percent and about 10 weight percent fluorine, calculated as the element, the majority of which fluorine is chemically bound to the rare earth constituents in the form of rare earth oxyfluorides.

One method of removing fluorine from bastnaesite is to treat the bastnaesite with a mineral acid, such as nitric acid, sulfuric acid, hydrochloric acid, boric acid, or combinations thereof, to solubilize the rare earths. Such a treatment will produce a fluorine-containing precipitate and a solution of rare earth constituents containing dissolved fluorine constituents. The rare earth constituents in solution are separated from the fluorine constituents by treating the solution with oxalic acid to precipitate the rare earths in the form of rare earth oxalates. This substantially fluorine-free precipitate is then redissolved in a mineral acid to produce a solution of rare earth constituents substantially free of fluorine. These rare earth constituents, which comprise a mixture of rare earth elements in substantially the same proportions as found in the bastnaesite starting material, can either be added to a solid inorganic refractory oxide carrier, such as clay and/or alumina, to form sorbent particles that are mixed with the particles of cracking catalyst in the FCC unit, or the rare earth constituents can be added directly to the cracking catalyst particles. Although it is preferred to treat the solution of rare earth constituents with oxalic acid to precipitate rare earth oxalates, it will be understood that any organic or inorganic acid which will react with the rare earth constituents in solution to form a precipitate containing rare earth components may be used.

An alternative method for treating bastnaesite to remove fluorine also involves contacting the bastnaesite with a mineral acid to form fluorine-containing solids and a fluorine-containing solution of soluble rare earth components. The resulting liquid solution is then separated from the solids by filtration or other means and heated, preferably in a vacuum, to evaporate more than about 50 percent of the original volume of the liquid, preferably more than about 70 percent. During this heating step fluorine compounds are volatilized, thereby producing a concentrated solution of soluble rare earth constituents having a low concentration of fluorine, usually less than about 0.5 grams per liter, preferably less than about 0.3 grams per liter. This solution can then be incorporated into an inorganic refractory oxide carrier or the cracking catalyst particles to produce the sulfur sorbent of the invention.

As mentioned above, the rare earth constituents produced by treating bastnaesite to remove substantially all of its fluorine can either be incorporated into the cracking catalyst particles or into a porous, inorganic refractory oxide carrier to produce separate sorbent particles that can be mixed with the catalytic cracking catalyst in the FCC unit. The porous, inorganic refractory oxide carrier may be alumina, preferably gamma alumina, natural or synthetic clays, silica-alumina, mixtures of one or more of these components and the like. The rare earth constituents are incorporated into the cracking catalyst or refractory oxide carrier by deposition or impregnation. One method of incorporating the rare earth constituents into the catalyst or refractory oxide carrier is to contact the catalyst or carrier particles with the solution of rare earth constituents derived from treating bastnaesite. The solution may be sprayed onto the catalyst or carrier particles or the particles may be slurried in the aqueous solution. After the catalyst or inorganic refractory oxide particles have been sprayed or slurried with the aqueous solution of rare earth components, they are calcined at a temperature between about 500° C. and about 900° C. for between about 2 hours and about 8 hours to form the sorbent particles. The dried sorbent particles will normally contain between about 5.0 and about 50 weight percent rare earth components, calculated as the sum of the respective oxides, preferably between about 10 and about 40 weight percent. When the particles of sorbent comprise separate particles apart from the cracking catalyst, they are normally introduced into a FCC unit at a convenient location and mixed with the catalyst particles circulating in the unit. The amount of sorbent so added will vary with the individual cracking unit and with the amount of sulfur oxides desired to be removed from the regenerator flue gas. Usually, the sorbent particles are added at a rate such that, of the total amount of catalyst particles and sorbent particles circulating through the unit, between about 0.1 and about 20 weight percent of such particles, preferably between about 1.0 and about 10 weight percent, constitute the sulfur sorbent particles. The average size of the sulfur sorbent particles introduced into the FCC unit is preferably the same as the catalyst particles themselves, i.e., between about 20 and 100 microns in diameter.

It has been surprisingly found that the activity of sulfur sorbents containing rare earth components derived by treating bastnaesite to remove at least about 50 weight percent of its fluorine, or sulfur sorbents containing rare earth constituents obtained from any source, can be substantially promoted by using a transition metal component in combination with the rare earth components. The transition metal component will normally comprise an element selected from the group consisting of Group IB, Group IIB, Group IVA, Group VA, Group VIA, Group VIIA, and Group VIII of the Periodic Table of Elements. The transition metal component will preferably comprise an element selected from the group consisting of titanium, vanadium, chromium, manganese, iron, cobalt, nickel, copper, zinc, molybdenum, niobium, tungsten, and rhenium. More preferably, the transition metal component will comprise an element selected from the group consisting of cobalt, iron and copper. The most preferable transition metal component for use with the rare earth constituents comprises cobalt. The transition metal component is usually mixed with the solution of rare earth constituents prior to impregnation onto the inorganic refractory oxide support or the cracking catalyst. Typically, the transition metal component will initially be in the form of a water soluble salt of the transition metal element utilized. A sufficient amount of the metal salt is used such that the sorbent particles contain after calcination between about 0.01 and about 20 weight percent transition metal component, calculated as the metal, preferably between about 1.0 weight percent and about 6.0 weight percent.

The use of a transition metal component in combination with rare earth components on an alumina support as a sulfur sorbent has been found to decrease emissions of sulfur oxides during cyclic catalytic cracking operations to unexpectedly low levels as compared to levels obtained using a sulfur sorbent comprising rare earth components and no transitional metal component on alumina or a sulfur sorbent comprising a transition metal component and no rare earth components supported on alumina. It has been surprisingly discovered that, although a sorbent composed of a cobalt compound impregnated on alumina is a relatively poor sulfur oxides sorbent when compared to a sorbent composed of rare earth components impregnated on alumina, the use in a FCC unit of a sorbent produced by adding cobalt components to a sorbent already comprising rare earth components impregnated on alumina will significantly decrease the amount of sulfur oxides emitted from the regenerator of the FCC unit. This decrease in sulfur oxides emissions has been found to typically range between about 20 and 50 percent.

The sulfur sorbent of the invention besides containing rare earth components, preferably derived by defluorinating bastnaesite, or a combination of rare earth components and a transition metal component, may also contain other components. Examples of such additional components that may be used include magnesium oxide and other known sulfur sorbing components, and oxidation promoters such as platinum components. The use of an oxidation promoter facilitates the conversion of sulfur dioxide to sulfur trioxide. The latter sulfur oxide is believed to be the oxide which reacts with the sulfur sorbent in the regenerator of the FCC unit. If an oxidation promoter is used, it will usually be present in the sulfur sorbent in relatively small amounts, preferably between about 1.0 and about 10 ppmw, calculated as the element. If magnesium oxide or a similar sulfur sorbing component is present in the sulfur sorbent, it will normally be present in an amount ranging between about 5.0 and about 40 weight percent, preferably between about 10 and about 30 weight percent, calculated as MgO and based on the final dry weight of the sorbent.

The process of the invention is directed to reducing the amount of sulfur oxides emitted from the regenerators of FCC units processing sulfur-containing hydrocarbon feedstocks. Typical feedstocks that may be converted to lower boiling hydrocarbons in such units include sulfur-containing gas oils, residual fractions, crude oil, naphthas and the like. The total concentration of sulfur in most feedstocks, whether the sulfur is present in elemental or combined forms or both, will normally range between about 0.1 and 3.0 weight percent, calculated as elemental sulfur. Normally, the sulfur in the hydrocarbon feedstock will be present as organic sulfur compounds rather than free sulfur or inorganic sulfur compounds.

In the process of the invention, any suitable cracking catalyst known in the art to have cracking activity at elevated temperatures, normally temperatures above about 750° F., may be used in the FCC unit. Preferred catalysts are fluidizable cracking catalysts comprised of a crystalline aluminosilicate zeolite dispersed in a porous, inorganic refractory oxide matrix or binder. Any crystalline aluminosilicate zeolite may be used as a component of the catalyst; however, X and Y zeolites are preferred with Y zeolites being most preferred. The inorganic refractory oxide component in the finished catalyst may be silica-alumina, silica, alumina, natural or synthetic clays, mixtures of one or more of these components and the like. The stability and/or acidity of the zeolite component of the cracking catalyst may be increased by exchanging the zeolite with ammonium ions, hydrogen ions, polyvalent cations such as rare earth-containing cations, magnesium cations or calcium cations, or a combination of ammonium ions, hydrogen ions and polyvalent cations, thereby lowering the sodium content until it is less than about 0.8 weight percent, preferably less than about 0.5 weight percent and most preferably less than about 0.3 weight percent, calculated as $Na_2O$. Methods of carrying out the ion exchange are well known in the art. A typical catalyst for use in the invention comprises a crystalline aluminosilicate Y zeolite dispersed in silica-alumina wherein the finished catalyst contains between about 25 and about 60 weight percent alumina, between about 30 and about 60 weight percent silica and between about 1.0 and about 40 weight percent zeolite.

As mentioned previously, the sulfur sorbent of the invention may exist as separate particles mixed with the catalyst particles in the FCC unit or it may form part of the catalyst particles themselves. If the sulfur sorbent is to form part of the catalyst itself, the rare earth constituents derived by defluorinating bastnaesite may be impregnated directly onto the finished catalyst particles along with, if desired, a transition metal component. Preferably, however, the sulfur sorbent will comprise particles separate from the catalytic cracking catalyst prepared as described earlier. This embodiment of the process of the invention is discussed below.

In the riser or cracking reaction zone of the FCC unit, the circulating particles of sulfur sorbent and catalyst are mixed in a fluidized reaction zone with incoming feedstock that has been vaporized. Conditions in the riser are selected from those conventionally used to produce the required product from the feedstock. Normally, the reaction temperature will range between about 800° F. and about 1100° F., preferably between about 900° F. and about 1000° F. Typically, the pressure in the riser will range between about 15 p.s.i.g. and about 30 p.s.i.g., preferably between about 20 p.s.i.g. and about 25 p.s.i.g. The velocity of the fluidizing vapors will usually be in the range between about 20 and about 60 feet per second and the residence time of the mixture of catalyst particles and sulfur sorbent particles within the riser will typically range between about 1.0 and about 10 seconds. The riser will normally comprise a reaction vessel in which the mixture of catalyst particles, sorbent particles and hydrocarbon feedstock is fed vertically and concurrently.

As the mixture of catalyst particles, sulfur sorbent particles and feedstock pass cocurrently through the riser under conventional fluid catalytic cracking conditions, the feedstock is converted into valuable hydrocarbon products of lower average molecular weight and lower average boiling point. A portion of the feedstock, however, is converted to sulfur-containing coke, which accumulates upon the surfaces of the catalyst particles, thereby deactivating the catalyst for further cracking of hydrocarbons into product. Although a large proportion of the sulfur originally present in the feedstock is recovered with the product hydrocarbon vapors in the form of hydrogen sulfide and sulfur-containing hydrocarbon vapors, a significant proportion of the sulfur remains in various organic forms with the coke deposited on the catalyst particles. Normally, the concentration of sulfur in combined and elemental forms in the coke ranges between about 0.5 and about 12.0 percent by weight, calculated as elemental sulfur.

The effluent from the riser will include product oil vapors, hydrogen sulfide, deactivated catalyst particles containing coke deposits and sorbent particles. The effluent is passed to a separation zone, such as a cyclone separator, where the product hydrocarbon vapors and hydrogen sulfide are separated from the deactivated catalyst particles and the active sorbent particles and then passed downstream to conventional processing facilities for removal of the hydrogen sulfide from the product hydrocarbons. The deactivated catalyst and activated sorbent particles are then passed to a stripper where, in the presence of a stripping gas, preferably steam, the catalyst is partially stripped of hydrocarbons while a portion of the sulfur compounds contained in the coke is partially converted to hydrogen sulfide. Conditions within the stripper are preferably maintained so as to recover as much hydrogen sulfide-containing hydrocarbon product vapors as is economically possible. Normally, the temperature within the stripping vessel is maintained between about 850° F. and about 1050° F. while the pressure ranges between about 20 p.s.i.g. and about 50 p.s.i.g.

After the catalyst particles and sorbent particles are stripped, they are passed to a regenerator wherein they are contacted with a gas, such as air, which contains molecular oxygen at elevated temperatures ranging between about 1000° F. and about 1500° F., preferably between about 1250° F. and about 1400° F. As the oxygen-containing gas is passed upwardly through the bed of catalyst and sorbent particles in the regenerator, coke remaining on the catalyst particles is combusted to produce carbon oxides. After the coke has been removed from the catalyst particles by combustion, the particles will contain coke in a proportion less than about 0.5 weight percent based upon the weight of the catalyst, preferably less than about 0.2 weight percent. By removal of the coke, the catalyst particles are restored to an acceptably active state and are recycled to the riser or catalytic reaction zone.

As the sulfur-containing coke deposited on the catalyst particles is combusted in the regenerator, sulfur oxides, such as $SO_2$ and $SO_3$, are produced. These sulfur oxides, primarily $SO_3$, react with the sorbent particles to produce solid sulfur components, normally sulfates, within the particles. The reaction of the sulfur oxides with the sorbent particles results in a reduced concentration of sulfur oxides in the flue gas exiting the regenerator. The spent sulfur sorbent produced in the regenerator by the reaction of sulfur oxides with the particles of sulfur sorbent is then passed along with the reactivated catalyst to the riser or reaction zone. Here, at temperatures normally ranging between about 800° F. and about 1100° F., the solid sulfur components on the spent sorbent particles are converted into hydrogen sulfide, thereby producing a sorbent depleted in sulfur components that is reactivated for the sorption of sulfur oxides under conditions extant in the regenerator. The hydrogen sulfide produced under reaction conditions in the riser exits the riser along with the hydrocarbon product vapors and is passed to downstream units where the hydrogen sulfide is removed from the product vapors.

The majority of the catalyst particles subjected to carbon burnoff in the regenerator is recycled to the riser for use to crack hydrocarbons. Some of the particles, however, are continuously withdrawn from the FCC unit because, after many cycles of operation, the catalyst particles gradually lose activity. Thus, in a typical FCC unit, between about 1.0 and about 5.0 weight percent of the catalyst inventory is replaced by fresh catalyst each day and concomitantly therewith, sorbent particles are fed to the unit to replace those removed with the catalyst particles and thus maintain the proportion of sulfur sorbent particles to sulfur sorbent particles plus catalyst particles in the unit at a desired level sufficient to reduce sulfur oxide emissions below the amount produced by a similarly operating unit in which catalyst particles only are circulated.

As discussed above, the sulfur sorbent of the invention operates to reduce sulfur oxide emissions as the sorbent is continuously cycled from the riser or reaction zone, through the stripper, to the regenerator and back to the reaction zone by reacting with sulfur oxide compounds in the regenerator and subsequently releasing them in the riser and/or stripper in the form of hydrogen sulfide. The sorbent particles thus undergo alternate changes in chemical form, involving oxidation reactions in the regenerator and reduction and/or hydrolysis reactions in either the riser or stripper or both. In the regenerator, the sorbent particles are believed to react with sulfur oxide components to produce solid compounds containing both sulfur and rare earth element atoms and thereby reduce the amount of sulfur oxide compounds discharged from the regenerator with the flue gas. In the riser or reaction zone, at least some of the solid compounds containing both rare earth elements and sulfur atoms release hydrogen sulfide and are thereby converted to forms suitable for subsequently removing sulfur oxide compounds in the regenerator. Reactions similar to those in the riser may also take place in the stripper, resulting in the release of the sulfur contained in the sorbent particles as hydrogen sulfide and the conversion of the sorbent particles to a form more active for removing sulfur oxide components in the regenerator.

An important advantage of using the sorbent of the invention, which may contain rare earth constituents derived by treating bastnaesite to remove at least about 50 weight percent of its fluorine, is that the sorbent has been found to be easily reactivated by releasing hydrogen sulfide at the temperatures normally encountered in the riser and/or stripper. On the other hand, sorbent particles comprising natural bastnaesite or bastnaesite that has been treated by steaming, leaching or calcining still contain a substantial amount of rare earth oxyfluorides and have been found to be difficult to reactivate in the riser and/or stripper. Thus, such sorbent particles tend to deactivate rather rapidly during multiple cycles through a FCC unit. By removing the fluorine chemically bound to the rare earths in the form of oxyfluorides from the bastnaesite and using the resultant rare earth constituents which are substantially free of rare earth oxyfluorides as a part of the sorbent particles, it has been found that the activity of the sorbent can be maintained during many cycles of FCC unit operations because the sulfur components formed in the sorbent by reaction of the sorbent with sulfur oxides in the regenerator are easily converted to hydrogen sulfide under the conditions normally encountered in the riser and/or stripper. Furthermore, it has been found that the use of a transition metal component in combination with the rare earth constituents not only results in lowering the temperature at which reactivation takes place in the riser and/or stripper but also results, as discussed previously, in unexpectedly high activity for sulfur oxides removal.

The nature and objects of the invention are further illustrated by the following examples, which are provided for illustrative purposes only and not to limit the invention as defined by the claims. Examples 1 and 2 describe two methods of producing rare earth components from bastnaesite by treating the bastnaesite to remove fluorine chemically bound to the rare earths in the form of rare earth oxyfluorides. Examples 3 through 11 describe various sulfur sorbents prepared either from commercial sorbents or rare earth components produced similarly to those in Examples 1 and 2. Example 12 demonstrates that sulfur sorbents containing rare earth components derived from bastnaesite are active for reducing the emissions of sulfur oxides from catalytic cracking units and that the addition of a transition metal component such as cobalt to a sorbent containing rare earth constituents unexpectly increases the activity of the sorbent for reducing such emissions.

EXAMPLE 1

One hundred grams of boric acid is dissolved in 3,000 milliliters of 25 volume percent nitric acid and the resultant solution is placed in a three-necked flask equipped with a condenser. One hundred and fifty grams of bastnaesite supplied by Molycorp, Incorporated, which had been leached with acid to remove substantial amounts of calcium and strontium, are added to the flask and the resultant slurry is heated to 100° C. while being continuously stirred with an electric stir motor equipped with a stirring paddle. The bastnaesite used contained about 80 weight percent rare earths, calculated as the sum of the respective rare earth oxides, and about 5.0 weight percent fluorine, calculated as the element. The distribution of the individual major rare earth elements in the starting basnaesite is shown in Table 1 below.

TABLE 1

| | Distribution of Rare Earth Elements* | |
|---|---|---|
| | Starting Bastnaesite | Combined Rare Earth Oxalate Precipitates |
| $La_2O_3$ | 32.3% | 26.3% |
| $CeO_2$ | 51.7% | 53.6% |
| $Pr_6O_{11}$ | 4.0% | 5.0% |
| $Nd_2O_3$ | 12.0% | 15.1% |

*Distribution is based on the amount of each individual major rare earth element present, calculated as the oxide, to the sum of those rare earth elements, calculated as the oxide.

The slurry is allowed to reflux for 12 hours at 100° C. after which time it is filtered using a buchner funnel. The filtrate is cooled to 20° C. and mixed with a solution of 80 grams of oxalic acid dissolved in 500 milliliters of water. This treatment produces a precipitate of rare earth oxalates which is recovered by filtration. The remaining filtrate is again mixed with another solution of oxalic acid prepared in a similar manner to produce a second precipitate of rare earth oxalates, which is again recovered by filtration. The two precipitates of rare earth oxalates are combined and analyzed along with the final filtrate for rare earths and fluorine. The combined precipitates contain 99 weight percent rare earths, calculated as the sum of the respective rare earth oxides, and about 100 ppmw fluorine, calculated as the element. The fluorine content of the precipitate represents over a 99 weight percent removal of fluorine with respect to the original fluorine content of the bastnaesite. The distribution of the individual major rare earth elements in the combined precipitates is shown in Table 1.

EXAMPLE 2

The procedure of Example 1 is again followed except no boric acid is dissolved in the nitric acid and after the first filtration, 820 milliliters of the filtrate, instead of being treated with oxalic acid, is placed in a rotary evaporator, a piece of equipment comprised of a flask which holds the filtrate at an angle so that as the flask is rotated under a vacuum the liquid filtrate spreads in a thin sheet on the inside walls of the flask. The vacuum increases the vapor pressure of the fluorine constituents in the filtrate, thereby allowing them to boil off at a lower temperature than would be possible at atmospheric pressure. A vacuum of 20 millimeters mercury is applied to the rotary evaporator and the flask is immersed in a water bath set at 85° C. The filtrate is allowed to remain in the rotary evaporator until the liquid volume is reduced to 300 milliliters. If all of the filtrate was treated in the above-described manner instead of just 820 milliliters, a fluorine material balance would indicate that the fluorine content of the evaporated solution represents about a 95 weight percent removal of fluorine with respect to the original fluorine content of the bastnaesite.

EXAMPLE 3

A sulfur sorbent is prepared by dissolving 11.7 grams of cobalt nitrate and 0.001 grams of dihydrogen hexachloroplatinate in sufficient water so that the total volume is 40 milliliters. The solution is then mixed with 100 grams of Catapal SB alumina, a spray dried alumina produced and sold by the Conoco Chemicals Divisions of DuPont Chemical Company, that had been calcined at 580° C. for 4 hours to remove any water. The solution of cobalt nitrate is mixed with the calcined Catapal SB alumina by stirring so that the Catapal alumina is uniformly impregnated to the point of incipient wetness. The resultant material is then dried overnight at 150° C. and calcined at 580° C. for 4 hours. The resultant dried alumina impregnated with cobalt is then sieved to produce particles ranging between 50 and 90 microns in diameter. The composition of the sorbent is set forth in Table 2.

EXAMPLE 4

Another sulfur sorbent is prepared following the procedure of Example 3 except instead of impregnating 100 grams of calcined Catapal SB alumina with cobalt nitrate as was done in Example 3, 100 grams of Davison "R" additive is used. Davison "R" additive is produced and sold by the Davison Chemical Division of W. R. Grace & Company for reducing the emissions of sulfur oxides from commercial FCC units. The procedures for drying and calcining set forth in Example 3 are followed. An analysis of the resultant sulfur sorbent is set forth in Table 2.

EXAMPLE 5

Another sulfur sorbent is prepared by adding 50 grams of the rare earth oxalates produced in Example 1 to 200 milliliters of 40 volume percent nitric acid and then heating the resultant mixture to boiling to dissolve the oxalates. The resultant solution is boiled until its volume is reduced to 60 milliliters. The solution is then allowed to cool to room temperature and 0.001 grams of dihydrogen hexachloroplatinate is dissolved therein.

The resultant solution is then mixed slowly with 70 grams of calcined Catapal SB alumina with vigorous stirring until the Catapal SB alumina is uniformly impregnated to the point of incipient wetness. The resultant material is then dried overnight at 150° C. and calcined at 580° C. for 4 hours. After calcination, the material is sieved so that it contains particles ranging in size between 50 and 90 microns. The composition of the resultant sorbent is set forth in Table 2.

EXAMPLE 6

Another sulfur sorbent is prepared as described in Example 5 except that 11.7 grams of cobalt nitrate is added to the solution used to impregnate the calcined Catapal SB alumina. The composition of the resultant sulfur sorbent is shown in Table 2.

EXAMPLE 7

Another sulfur sorbent is prepared as described in Example 5 except that 15.3 grams of ferric nitrate is added to the solution used to impregnate the calcined Catapal SB alumina. The composition of the resultant sorbent is set forth in Table 2.

EXAMPLE 8

A filtrate containing rare earth components produced by a procedure similar to that discussed in Example 2 is heated in a flask on a hot plate to reduce the volume from 300 milliliters to 60 milliliters. After heating, 0.001 grams of dihydrogen hexachloroplatinate and 9.3 grams of cobalt nitrate are added. The resultant solution is then mixed with 70 grams of calcined Catapal SB alumina and the resultant mixture is stirred until incipient wetness is reached. The material is then dried at 150° C. overnight and calcined at 580° C. for 4 hours. After calcination, the dried material is sieved to produce particles ranging between 50 and 90 microns in size. The composition of the resultant sorbent is shown in Table 2.

EXAMPLE 9

Another sulfur sorbent is prepared from the sorbent produced in Example 5 by further impregnating the sorbent of Example 5 in an eight step procedure with a solution of 35 grams of magnesium oxide dissolved in 400 milliliters of 30 volume percent nitric acid. One hundred grams of the sorbent made pursuant to the procedure of Example 5 are first mixed with 50 milliliters of the magnesium oxide solution, stirred to incipient wetness and dried at 150° C. This procedure is repeated seven more times. After the final impregnation, the resultant material is dried overnight at 150° C., then calcined for 4 hours at 580° C. After calcination, the material is sieved into particles ranging in size between 50 and 90 microns. The composition of the resultant sorbent is shown in Table 2.

EXAMPLE 10

Another sulfur sorbent is prepared from the sorbent produced in Example 5. One hundred grams of the sorbent prepared following the procedure of Example 5 is mixed with 38 milliliters of a solution made by dissolving 69.3 grams of magnesium chloride and 13.2 grams of cobalt nitrate in water. The mixture is stirred until it reaches the point of incipient wetness and then dried overnight at 150° C. The dried material is calcined at 580° C. for 4 hours and then sieved so it contains particles ranging in size between 50 and 90 microns. The composition of the resultant sorbent is set forth in Table 2.

EXAMPLE 11

The last sulfur sorbent is prepared by dissolving 25 grams of the rare earth oxalates produced in Example 1 in 100 milliliters of 40 volume percent nitric acid. To this solution is added 0.001 grams of dihydrogen hexachloroplatinate, 15 grams of magnesium oxide, 9.7 grams of cobalt nitrate and 18 grams of Catapal SB alumina that had not been calcined. The resultant mixture is stirred to form a paste. The paste is dried overnight at 150° C. and the resultant dried material is calcined at 580° C. for 4 hours. The calcined material is ground to a powder and sieved into particles ranging in size between 50 and 90 microns. The composition of the resultant sorbent is shown in Table 2.

TABLE 2

| Sulfur Sorbent | Surface Area ($m^2/g$) | Total Rare Earths (wt. %) | Composition of Sulfur Sorbents[a] Individual Rare Earths $La_2O_3$ (wt. %) | $CeO_2$ (wt. %) | $Pr_6O_{11}$ (wt. %) | $Nd_2O_3$ (wt. %) | Other Components MgO (wt. %) | CoO (wt. %) | $Fe_2O_3$ (wt. %) |
|---|---|---|---|---|---|---|---|---|---|
| DESOX | 162 | 8.2 | 0.2 | 8.0 | — | — | 32.0 | — | — |
| Davison "R" | 130 | 23.9 | 13.7 | 3.5 | 1.8 | 4.9 | — | — | — |
| Example 3[b] | 194 | — | — | — | — | — | — | 2.9 | — |
| Example 4 | 131 | 22.0 | 12.8 | 3.1 | 1.7 | 4.4 | — | 3.0 | — |
| Example 5[b] | | 31.0 | 8.8 | 16.4 | 1.6 | 4.2 | — | — | — |
| Example 6[b] | 119 | 28.5 | 8.7 | 14.9 | 1.3 | 3.6 | — | 3.1 | — |
| Example 7[b] | 126 | 29.2 | 8.7 | 15.6 | 1.3 | 3.6 | — | — | 3.4 |
| Example 8[b,c] | 157 | 18.1 | 1.9 | 15.6 | 0.1 | 0.5 | — | 3.0 | — |
| Example 9[b] | 81 | 38.1 | 10.6 | 21.0 | 1.7 | 4.8 | 19.9 | — | — |
| Example 10[b] | 100 | 33.7 | 10.0 | 18.2 | 1.5 | 4.0 | 9.4 | 2.7 | — |
| Example 11[b] | 90 | 33.0 | 10.0 | 17.3 | 1.5 | 4.2 | 27.9 | 2.6 | — |

[a]All of the experimental sulfur sorbents made in Examples 3 and 5 through 11 are supported on spray-dried alumina.
[b]These sulfur sorbents contain between 5 and 30 ppmw platinum.
[c]This sulfur sorbent also contained 0.4 weight percent fluorine.

EXAMPLE 12

The activities of the sulfur sorbents prepared in Examples 3 through 11 for removing sulfur oxides from regenerator flue gases are evaluated in a nonadiabatic, circulating pilot catalytic cracking unit and compared to the activities of two commercially available sulfur sorbents, Davison "R" and DESOX, the latter being produced and sold by Katalistiks. The compositions of the Davison "R" and DESOX sulfur sorbent are shown in Table 2.

A sulfur-containing gas oil feedstock having an API gravity of 22.3°, containing 1.4 weight percent sulfur, and having an initial boiling point of 459° F. and a final boiling point of 1043° F. is fed to the bottom of the pilot plant riser where the feed is mixed with regenerated catalyst. The feed vaporizes and flows with the catalyst up the riser into a disengaging vessel where the catalyst and oil vapors disengage. The riser length is about 30 feet and represents an average residence time of about 2 seconds. The riser outlet temperature is fixed at 975° F. After the product and catalyst disengage, the catalyst is steam stripped in a stripper at about 980° F. The spent and stripped catalyst is then passed to the regenerator where it is contacted with air at temperatures high enough to burn carbon off the spent catalyst and thereby produce the regenerated catalyst that is mixed with the feed. Approximately 4000 grams of an equilibrium catalytic cracking catalyst obtained from a commercial unit is circulated through the riser, stripper and regenerator of the pilot plant unit.

In each run carried out, a sufficient amount of the sulfur sorbent to be evaluated is mixed with the catalyst in the pilot plant unit so that the sulfur sorbent represents 1.0 weight percent of the particles circulating therein. The catalyst-to-feed weight ratio is adjusted to give a nominal coke yield of 6 weight percent and excess oxygen in the regenerator flue gas is controlled at about 2 volume percent. After steady state conditions have been achieved, the flue gas emitted from the regenerator is analyzed for sulfur dioxide utilizing an on-line UV analyzer. The feed conversions are calculated based on the amount of feed converted to products boiling below 450° F. This procedure is repeated for each sulfur sorbent evaluated and one run is conducted with no added sorbent in order to establish a baseline for comparison. The results of these tests are set forth in Table 3.

a decrease of only about 29 percent. The results of run 5 in which the sulfur sorbent prepared in Example 4 is evaluated, however, are surprising and unexpected. The sorbent used in this run is the Davison "R" commercial additive impregnated with 3.0 weight percent cobalt, calculated as CoO. Since the steady state sulfur dioxide emissions obtained with Davison "R" alone in run 3 are 25 kilograms per thousand barrels and the emissions obtained in run 4 utilizing cobalt oxide on alumina are 65 kilograms per thousand barrels, a 29 percent decrease from the emissions obtained in run 1, it would be expected that when Davison "R" is impregnated with similar amounts of cobalt, the steady state sulfur dioxide emissions would be at most 29 percent less than the 25 kilograms per thousand barrels obtained in run 3. This, however, is not the case as indicated by run 5 in which the steady state emissions of sulfur dioxide obtained using Davison "R" impregnated with cobalt as the sulfur sorbent are 11 kilograms per thousand barrels, a 56 percent decrease in sulfur oxide emissions from the emissions obtained in run 3 using Davison "R" alone. The data from run 5 also show that the activity of Davison "R" for reducing sulfur oxide emissions can be increased to the same level as that of DESOX, a more expensive additive, by impregnating Davison "R" with cobalt.

Runs 6 through 8 in Table 3 demonstrate that sulfur sorbents containing rare earths derived from bastnaesite by removing substantially all of the fluorine contained in the bastnaesite are as effective in reducing sulfur dioxide emissions as is the Davison "R" commercial sorbent. The data for run 7 indicate that the addition of cobalt to the sorbent results in an increase in the activity of the sorbent for reducing sulfur dioxide emissions.

TABLE 3

| Run Number | Sulfur Sorbent | Composition (weight % on alumina) Rare Earth Oxides | Transition Metal | Other | Steady State Sulfur Dioxide Emissions (kg/Mbbl) | Conversion (volume %) |
|---|---|---|---|---|---|---|
| 1 | None | — | — | — | 91 | 70.2 |
| 2 | DESOX | 8.2 | — | 32.0% MgO | 10 | 71.3 |
| 3 | Davison "R" | 23.9 | — | — | 25 | — |
| 4 | Example 3 | — | 2.9% CoO | — | 65 | 71.9 |
| 5 | Example 4 | 22.0 | 3.0% CoO | — | 11 | 69.7 |
| 6 | Example 5[a] | 31.0 | — | — | 21 | 70.7 |
| 7 | Example 6[a] | 28.5 | 3.1% CoO | — | 16 | 68.3 |
| 8 | Example 7[a] | 29.2 | 3.4% $Fe_2O_3$ | — | 21 | 66.2 |
| 9 | Example 8[b] | 18.1 | 3.0% CoO | 0.4% F | 14 | 68.7 |
| 10 | Example 9[a] | 38.1 | — | 19.9% MgO | 32 | 68.6 |
| 11 | Example 10[a] | 33.7 | 2.7% CoO | 9.4% MgO | 19 | 68.0 |
| 12 | Example 11[a] | 33.0 | 2.6% CoO | 27.9% MgO | 15 | 69.3 |

[a]The rare earths used in these sorbents were derived from bastnaesite following the procedure of Example 1.
[b]The rare earths used in this sorbent were derived from bastnaesite following a procedure similar to that of Example 2.

As can be seen from run 1 in Table 3, the sulfur dioxide emissions using no sorbent mixed with the catalyst circulating through the pilot plant is 91 kilograms per thousand barrels. Runs 2 and 3 in Table 3 indicate that the DESOX and Davison "R" commercial sulfur sorbent additives are both effective in reducing the sulfur dioxide emissions with DESOX being by far the most effective. The DESOX additive reduces sulfur dioxide emissions by about 90 percent, whereas use of the Davison "R" additive results in about a 72 percent decrease in sulfur dioxide emissions.

The sulfur sorbent prepared in Example 3, which contains 2.9 weight percent cobalt, calculated as CoO, impregnated on calcined Catapal SB alumina, is evaluated in run 4. This sorbent reduces the sulfur dioxide emissions from 91 to 65 kilograms per thousand barrels, The sulfur sorbents tested in runs 10 through 12 all contain magnesium oxide along with rare earths derived from bastnaesite in accordance with the procedure described in Example 1. The sulfur sorbents tested in runs 11 and 12 contain approximately 2.6 weight percent cobalt, calculated as CoO, whereas the sorbent tested in run 10 contains no cobalt. A comparison of runs 11 and 12 with run 10 indicates that the presence of the cobalt has a significant effect in lowering sulfur dioxide emissions. A comparison of run 11 with run 12 indicates that the presence of greater amounts of magnesium oxide has some effect in reducing sulfur dioxide emissions but not nearly the effect obtained using cobalt. The sulfur dioxide emissions obtained in run 12 where the sorbent contains cobalt and magnesium oxide were about half those obtained in run 10 where the sorbent contains no cobalt.

The activity of the sorbents for removing sulfur dioxide from regenerator flue gases appears to be independent of the distribution of the various rare earth constituents. In run 3, the Davison "R" commercial additive, shown in Table 2 to contain 13.7 weight percent lanthanum oxide and 3.5 weight percent cerium oxide, yielded sulfur dioxide emissions of 25 kilograms per thousand barrels. On the other hand, the sulfur sorbent used in run 6, shown in Table 1 to be rich in cerium not lanthanum and to contain 8.8 weight percent lanthanum oxide and 16.4 weight percent cerium oxide, gave a similar level of sulfur dioxide emissions, 21 kilgrams per thousand barrels.

A comparison of the conversions obtained in runs 2 through 12 with the baseline conversion obtained in run 1 indicates that the sorbent used in run 8, which sorbent contains iron, was the only one that had any significant effect on conversion. The conversions obtained with all the various sulfur sorbents except the one evaluated in run 8 ranged between 68 and 72 volume percent and were all within the experimental error of the 70.2 percent baseline conversion obtained in run 1.

It will be apparent from the foregoing that the invention provides active sulfur sorbents which, when used in a cyclic catalytic cracking operation, maintain their activity for reducing emissions of sulfur oxides. In one embodiment of the invention, the sulfur sorbent comprises cobalt or other transition metal component in combination with rare earth constituents derived from any source. In another embodiment of the invention, the sulfur sorbent comprises rare earth constituents derived from bastnaesite by treating the bastnaesite to remove at least 50 weight percent of its fluorine content. In still another embodiment of the invention, the sulfur sorbent comprises rare earth constituents derived from bastnaesite in combination with a transition metal component such as cobalt.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

We claim:

1. A catalytic cracking process which comprises circulating a bed of particulate cracking catalyst in combination with a sulfur sorbent through a cracking zone wherein said catalyst particles promote the conversion of a sulfur-containing hydrocarbon feedstock to lower molecular weight products and then through a regeneration zone wherein coke deposited on the particles of said cracking catalyst is combusted off said particles at a temperature between about 1000° F. and about 1250° F., said sulfur sorbent comprising (1) a rare earth component or mixture of rare earth components, and (2) a cobalt component.

2. A process as defined by claim 1 wherein said sulfur sorbent further comprises a porous, inorganic refractory oxide component.

3. A process as defined by claim 1 wherein said sulfur sorbent comprises (1) a mixture of rare earth components derived from bastnaesite by treating said bastnaesite to remove at least about 50 weight percent fluorine, calculated as the element, (2) a cobalt component, and (3) a porous, inorganic refractory oxide component.

4. A process as defined by claim 2 wherein said porous, inorganic refractory oxide component comprises alumina.

5. A process as defined by claim 4 wherein said alumina comprises gamma alumina.

6. A process as defined by claim 5 wherein said sulfur sorbent further comprises a platinum component.

7. A process as defined by claim 3 wherein said bastnaesite is treated by a process comprising (1) contacting said bastnaesite with a mineral acid to form a solid residue and a solution of soluble rare earth components containing dissolved fluorine components, (2) contacting said solution of rare earth constituents with oxalic acid to precipitate a mixture of rare earth oxalates from said solution, and (3) contacting said rare earth oxalates with a mineral acid to form said mixture of rare earth components derived from bastnaesite.

8. A process as defined by claim 1 wherein said cracking catalyst and said sulfur sorbent comprise the same particles.

9. A process as defined by claim 4 wherein said cracking catalyst comprises particles of a crystalline aluminosilicate Y zeolite dispersed in a porous, inorganic refractory oxide matrix and said sulfur sorbent comprises separate particles, other than said cracking catalyst particles, which separate particles comprise said rare earth component or mixture of rare earth components, said cobalt component, and said alumina.

10. A process as defined by claim 9 wherein said sulfur sorbent further comprises magnesium oxide.

11. A catalytic cracking process which comprises circulating a bed of particulate cracking catalyst in combination with a sulfur sorbent through a cracking zone wherein said catalyst promotes the conversion of a sulfur-containing hydrocarbon feedstock to lower molecular weight products and then through a regeneration zone wherein coke deposited on the particles of said cracking catalyst is combusted off said particles, said sulfur sorbent comprising a mixture of rare earth components derived from bastnaesite by treating said bastnaesite to remove at least 50 weight percent fluorine, calculated as the element.

12. A process as defined by claim 11 wherein said sulfur sorbent further comprises a porous, inorganic refractory oxide component.

13. A process as defined by claim 12 wherein said bastnaesite is treated by a process comprising (1) contacting said bastnaesite with a mineral acid to form a solid residue and a solution of soluble rare earth components containing dissolved fluorine components, (2) contacting said solution of rare earth components with an organic or inorganic acid which will react with said soluble rare earth components to produce a precipitate containing rare earth components, and (3) contacting said precipitate containing rare earth components with a mineral acid to form said mixture of rare earth components derived from bastnaesite.

14. A process as defined by claim 12 wherein said bastnaesite is treated by a process comprising (1) contacting said bastnaesite with a mineral acid to form a solid residue and a solution of soluble rare earth components containing dissolved fluorine components and (2) heating said solution of rare earth components under conditions such that volatile fluorine constituents are removed, thereby forming said mixture of rare earth components derived from bastnaesite.

15. A process as defined by claim 12 wherein said porous, inorganic refractory oxide component comprises alumina.

16. A process as defined by claim 15 wherein said sulfur sorbent further comprises a transition metal component selected from the group consisting of titanium, vanadium, chromium, manganese, iron, cobalt, nickel, copper, zinc, molybdenum, niobium, tungsten, and rhenium.

17. A process as defined by claim 16 wherein said transition metal component comprises cobalt.

18. A process as defined by claim 17 wherein said porous, inorganic refractory oxide component comprises gamma alumina.

19. A process as defined by claim 18 wherein said sulfur sorbent further comprises a platinum component.

20. A process as defined by claim 17 wherein said sulfur sorbent further comprises magnesium oxide.

21. A process as defined by claim 13 wherein said solution of rare earth components is contacted with oxalic acid to produce a precipitate containing rare earth oxalates.

22. A process as defined by claim 14 wherein said solution of rare earth components is heated in a vacuum.

23. A process as defined by claim 17 wherein the temperature in said regeneration zone is between about 1000° F. and about 1250° F.

24. A process as defined by claim 11 wherein said mixture of rare earth components is derived from bastnaesite by treating said bastnaesite to remove at least about 90 weight percent fluorine, calculated as the element.

25. A process as defined by claim 24 wherein said mixture of rare earth components is substantially free of rare earth oxyfluorides.

* * * * *